United States Patent [19]

Swanda

[11] 4,091,370

[45] May 23, 1978

[54] FLUID CONTROL FOR ELECTRICAL CIRCUIT

[76] Inventor: Franklin J. Swanda, 1107 W. Pine, Rogers, Ark. 72756

[21] Appl. No.: 723,656

[22] Filed: Sep. 15, 1976

[51] Int. Cl.[2] ..... G08B 21/00; G08B 29/00

[52] U.S. Cl. ..... 340/272; 200/81.4; 200/86 A; 340/39

[58] Field of Search ..... 340/272, 39, 38 R, 51; 200/86.5, 86 A, 85 R, 81.4, 81 R

[56] References Cited

U.S. PATENT DOCUMENTS

| | | | |
|---|---|---|---|
| 2,931,010 | 3/1960 | Geiser | 340/51 |
| 3,950,725 | 4/1976 | Kitajima | 340/39 |

*Primary Examiner*—Glen R. Swann, III

*Attorney, Agent, or Firm*—Young & Thompson

[57] ABSTRACT

A pneumatically-operated bell, such as is commonly used in service stations, has twin pneumatic hoses. The first is a conventional signal hose, actuating the bell when compressed. The second hose is laid parallel to the first and, when compressed, prevents actuation of the bell by the first hose for a predetermined period. In a first embodiment, the second hose opens a switch in the bell's electric circuit. In a second embodiment, the second hose actuates a valve to block air flow through the first hose to prevent its actuating the bell. As a result, vehicles exiting the service station compress the second hose first and thus no signal is produced, while vehicles entering the station produce a signal only when the front wheels cross the hoses. Thus false signals from exiting vehicles and false double signals are prevented.

5 Claims, 6 Drawing Figures

FIG 1
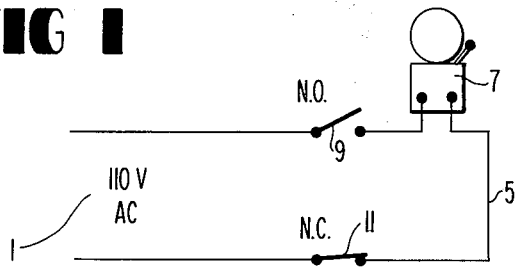
FIG 2
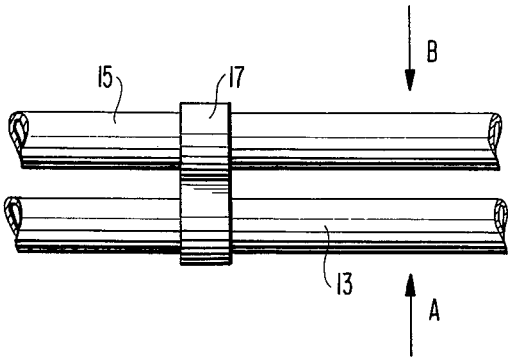
FIG 3
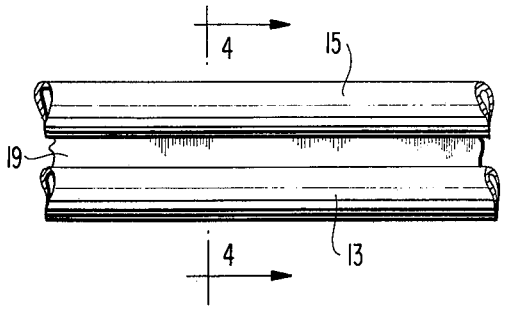
FIG 4
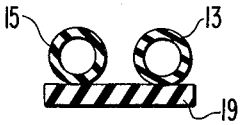
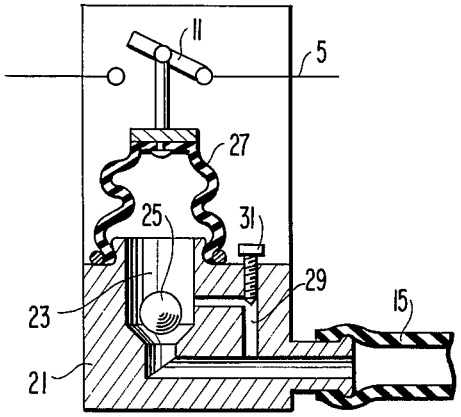
FIG 5
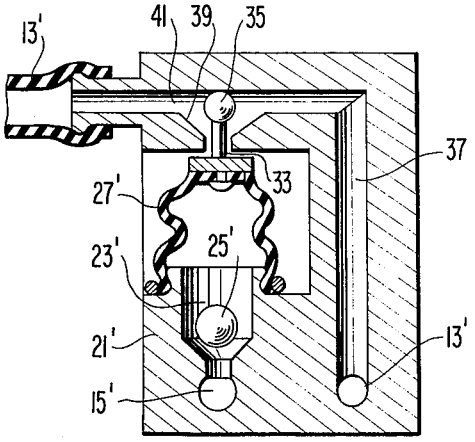
FIG 6

FLUID CONTROL FOR ELECTRICAL CIRCUIT

BACKGROUND & OBJECTS OF THE INVENTION

The present invention relates to fluid controls for electrical circuits, more particularly pneumatic controls for electrical signal circuits, for example of the type found in gasoline service stations, in which hoses are laid across the traffic lanes. A vehicle crossing the hose momentarily compresses the hose and sends a brief pneumatic pulse to a device for closing a signal circuit to cause, for example, an audible signal such as the ringing of a bell.

Such devices, however, have the disadvantage that they actuate the bell every time the hose is compressed. Thus, a vehicle entering a service station will actuate the bell twice, at an interval depending on the speed of the vehicle. Similarly, a vehicle leaving the station will actuate the bell twice. In fact, however, it is useful to the service station operator that only one signal be given, namely, when the vehicle enters the station. It is undesirable that a signal be given when the vehicle leaves the station; for if the operator is in the rear of the station and cannot see the area of the gas pumps, then he cannot tell by listening, whether there is a vehicle entering the station or a vehicle leaving the station. If a vehicle is merely leaving the station, then he need not come forward to offer services. Moreover, if an entering vehicle crosses the hose slowly, then the interval between the two signals may confuse the operator into believing that two vehicles have in fact entered, or one vehicle entered and one left, etc. In short, in the case of two-axled vehicles, there is approximately four times as much bell ringing in a service station as there need be, with the result that the operator spends a great deal of time answering what amounts to false alarms.

Accordingly, it is an object of the present invention to provide a pneumatic control for an electrical circuit, with means selectively to disable the operation of the control, whereby under certain circumstances the electrical circuit will be opened or closed, and under other circumstances will not.

Another object of the present invention is the provision of a pneumatic control for an electrical circuit, which is operative when compressive pressure is exerted from one direction and inoperative when compressive pressure is exerted from the opposite direction.

Still another object of the present invention is the provision of a pneumatic control for an electrical circuit, which cannot be actuated more than once in a given period of time.

A further object of the present invention is the provision of a pneumatic control for a signal circuit, in which a signal is given only under preselected conditions.

Finally, it is an object of the present invention to provide a pneumatic control for an electrical circuit, which will be relatively simple and inexpensive to manufacture, easy to install, adjust, maintain and repair, and rugged and durable in use.

Although the present application speaks broadly of electrical circuits, the preferred electrical circuit is a signal circuit, and the preferred signal is an audible signal such as a bell. At the same time, it will be recognized that the present invention is easily applicable to the control of a plurality of other types of electrical circuits.

BRIEF DESCRIPTION OF THE DRAWINGS

These and other objects, features and advantages of the present invention will become apparent from a consideration of the following description, taken in connection with the accompanying drawing, in which:

FIG. 1 is a simplified circuit diagram of an electrical circuit and circuit control according to one embodiment of the present invention;

FIG. 2 is a fragmentary top plan view of a first embodiment of twin hoses used in connection with the present invention;

FIG. 3 is a view similar to FIG. 2 but showing a modification thereof;

FIG. 4 is a cross-sectional view taken on the line 4—4 of FIG. 3;

FIG. 5 is a somewhat schematic cross-sectional view of a pneumatic switch actuator for disabling an electrical circuit according to the present invention; and FIG. 6 is a view similar to FIG. 5 but showing, instead of a direct electric control as in FIG. 5, a pneumatic control for blocking a pneumatic signal, which latter pneumatic signal controls an electrical circuit in accordance with the present invention.

DESCRIPTION OF THE PREFERRED EMBODIMENTS

Referring now to the drawing in greater detail, and first to FIG. 1, there is shown a schematic electrical diagram of a control according to a first embodiment of the present invention, in which mains current at 1 is fed to a signal circuit 5 which comprises in series an electrical signal in the form of a bell 7, a normally open switch 9 whose actuation to closed position to sound the bell is conventional, and a normally closed switch 11 whose actuation is according to the present invention.

The actuators for switches 9 and 11 comprise two rubber hoses 13 and 15, as best seen in two alternative embodiments in FIGS. 2 and 3. Hose 13 is a conventional hose of the type that lies across the traffic lanes in a gasoline service station, and whoe compression closes normally open switch 9. The operation of hose 13 to close switch 9 may be entirely conventional, as for example in any one of U.S. Pat. Nos. 1,950,301, 2,263,636 and 2,371,526, the disclosure of which is incorporated herein by reference.

Secured to hose 13 is side-by-side parallel relation, slightly spaced or not, is a second rubber hose 15, which, like hose 13, sends a pneumatic signal when compressed for example by the passage of a vehicle thereover. Hoses 13 and 15 are of course both closed at one end (not shown), so that compression results in a puff of air being emitted from the other end.

A releasable clamp 17 holds hoses 13 and 15 together in parallel relation. It will be understood that there are a plurality of clamps 17 spaced apart along the length of hoses 13 and 15, so that a flexible hose assembly is provided which can be distributed about the traffic lanes of a service station as desired, but which will lie flat on the concrete apron of the service station. As it makes a difference on which side hoses 13 and 15 lie, relative to each other and to the intended direction of traffic flow in the service station, the hoses 13 and 15 can, for the convenience of the operator, be readily visually distinguishable from each other: for example, hose 13 can be green and 15 red.

FIG. 3 differs from FIG. 2 in the manner in which hoses 13 and 15 are held in spaced parallel relation to each other. In FIG. 3, as best seen in FIG. 4, a flexible rubber strip 19 is secured to each of hoses 13 and 15 along their length; and this can be done by molding strip 19 and hoses 13 and 15 together as a unit at the time of manufacture. It is intended that strip 19 will be lowermost and hoses 13 and 15 uppermost, when the arrangement of FIGS. 3 and 4 is emplaced.

The purpose of hose 15 is in effect to disable hose 13 for a limited period of time, for example, four seconds. Thus, when a vehicle crosses hose 13 and 15 in that order, that is, in the direction of the arrow A in FIG. 2, hose 13 will send a signal to actuate bell 7. But then the front wheel of the vehicle will cross hose 15, which disables hose 13. When the rear wheel of the vehicle crosses hose 13, therefore, hose 13 will still be disabled and a second signal from bell 7 will not be given.

On the other hand, a vehicle travelling in the opposite direction, for example, leaving a gasoline service station in that direction B as seen in FIG. 2, will compresss hose 15 before 13, and thus will disable hose 13 before even the front wheels of the vehicle cross hose 13. Therefore, when a vehicle travels in direction B, neither the front wheels nor the rear wheels will cause a signal upon compression of hose 13.

However, the disablement of hose 13 is only temporary, so that when the predetermined time of disablement of hose 13 has elapsed, then hose 13 can be actuated again by a vehicle travelling in direction A.

Hose 15 can act in any of a number of ways according to the present invention. One such way is shown in FIG. 5, in which the pneumatic signal from hose 15 opens normally closed switch ~~11, the closing~~ of switch 11 being delayed by a time delay mechanism so that switch 11 will remain open for, say, four seconds, during which time the closing of switch 9 according to the conventional operation of hose 13, cannot actuate bell 7.

To this end, hose 15 is secured to a fixture 21 having a chamber 23 therein whose inlet is controlled by a one-way valve in the form of a ball 25. A resilient bellows 27, for example of rubber, closes the upper side of chamber 23 and is directly connected to switch 11, so that upon expansion of bellows 27 under the impetus of air blown in from hose 15, switch 11 is opened; but when bellows 27 collapses toward its normal or unstressed position, switch 11 is closed. Therefore, switch 11 is normally closed because bellows 27 is normally collapsed.

When a puff of air is received from hose 15, for example when a vehicle compresses hose 15, then ball 25 is raised to permit that puff of air to enter chamber 23 and expand bellows 27, thereby to open switch 11. But before bellows 27 can collapse again under its own resiliency, ball 25 has fallen to its seat, which closes the lower end of chamber 23 against the escape of air past ball 25.

In this position of the parts, switch 11 would tend to remain open indefinitely. But in order to provide for automatic closing of switch 11 after a predetermined time delay, a bleed passageway 29 from chamber 23 back to hose 15 is provided, controlled by a set screw 31 whose adjustment regulates the effective size of passageway 29 and hence the time required for air to escape from chamber 23 to permit bellows 27 to collapse and switch 11 to close. Thus, turning screw 31 in one direction will increase the time switch 11 remains open; while turning screw 31 in the opposite direction will decrease that time. It is accordingly a simple matter to calibrate screw 31, so that the time during which switch 11 will remain open and hose 13 and bell 7 inactivated, can be readily selected by the operator.

As indicated above, however, it is not necessary that the inactivating hose 15 function by opening the signal circuit 5. Many other arrangements can be provided, for temporarily disabling hose 13. One such other arrangement is shown in FIG. 6 in which both the hose 13′ and the hose 15′ are connected to the fixture 21′. In fitting 21′, the structure associated with hose 15′ is much the same as that shown in FIG. 5: thus, hose 15′ communicates with the chamber 23′ that is closed by a one-way valve in the form of a ball 25′, the other side of chamber 23′ being closed by a resilient bellows 27′ which can be the same as bellows 27 in FIG. 5. The exit of air from chamber 23′ is controlled by a bleed passageway under control of an adjustment screw (not shown in FIG. 6), which can be the same as the corresponding parts 29 and 31 in FIG. 5.

FIG. 6 differs from FIG. 5 principally in that hose 15′ does not open a switch. Instead, hose 15′ prevents the closure of switch 9 in FIG. 1. More specifically, hose 15′ prevents hose 13′ from closing the switch 9.

Thus, in FIG. 6, the rising of bellows 27′ raises a pin 33 that is fixedly secured to the upper side of bellows 27′. Pin 33 bears on the underside of a ball 35 disposed in passageway 37 that receives air from hose 13′. However, ball 35 is not secured to pin 33 but is entirely separate from and movable off pin 33. All that pin 33 does is to bear against the underside of ball 35 and to at least roll ball 35 up along its conical seat 39 upon expansion of bellows 27′.

When bellows 27′ is collapsed and pin 33 is in its lower or retracted position, then ball 35 is sufficiently far down in conical seat 39 that a puff of air from hose 13′, passing through passageway 37, simply passes over the top of ball 35 without moving it. But when ball 35 is in the raised position shown in FIG. 6, then a puff of air through 37 will strike ball 35 and move it into outlet opening 41 of passageway 37, thereby cutting off the flow of air through hose 13′ toward the conventional actuator (not shown) for closing switch 9. Thus, the FIG. 6 embodiment provides valve means actuated by hose 15′ to close hose 13′ to the escape of air therefrom.

In short, the embodiment of FIG. 5 is an electrical means for disabling hose 13; while the embodiment of FIG. 6 is a mechanical or pneumatic means for disabling hose 13.

Similarly, the means for retarding the collapse of bellows 27 can have a variety of other forms. An electrical means for time delay could be provided, which might, for example, send a current through a bimetallic resistive element whose deformation would disable hose 13 until cooling of the bimetallic element (not shown). Alternatively, a mechanical escapement (not shown) with relatively movable parts could be provided, for predetermining the time of disablement of hose 13.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. A pneumatic control for an electric circuit, comprising a pair of resilient hoses each closed at one end and secured together in parallel side-by-side relationship, means responsive to the compression of a first one of said hoses for controlling an electric circuit, means responsive to the compression of the second of said hoses for temporarily disabling the control of the electric circuit by said first hose, the last named responsive means comprising an expansible chamber that receives air from said second hose and expands to disable said first hose, and air bleed means for discharging air from said expansible chamber at a retarded rate thereby to predetermine the time during which the expanded chamber disables the control of the electric circuit by said first hose.

2. A control as claimed in claim 1, and means for selectively adjusting said predetermined time.

3. A control as claimed in claim 1, and an audible signal in said electric circuit.

4. A control as claimed in claim 1, said means responsive to compression of said first hose closing a normally open switch in said circuit, and said means responsive to compression of said second hose opening a normally closed switch in said circuit.

5. A control as claimed in claim 1 the last-named said responsive means comprising valve means to close said first hose to the escape of air therefrom.

* * * * *